US006938895B2

(12) United States Patent
Adams

(10) Patent No.: US 6,938,895 B2
(45) Date of Patent: Sep. 6, 2005

(54) MATCH THREE NUMBERS GAME OF CHANCE

(76) Inventor: Chris Adams, 6093 Rock Glen Dr., Elkridge, MD (US) 21075

( * ) Notice: Subject to any disclaimer, the term of this patent is extended or adjusted under 35 U.S.C. 154(b) by 0 days.

(21) Appl. No.: 10/739,311

(22) Filed: Dec. 19, 2003

(65) Prior Publication Data

US 2005/0133999 A1 Jun. 23, 2005

(51) Int. Cl.[7] ..... A63F 3/06
(52) U.S. Cl. ..... 273/139; 273/138.1; 273/138.2; 273/269; 463/17; 463/18; 463/19
(58) Field of Search ..... 273/139, 269, 273/138.1, 138.2; 463/17, 18, 19, 20, 25

(56) References Cited

U.S. PATENT DOCUMENTS 5,518,239 A * 5/1996 Johnston ..... 273/139
5,935,002 A * 8/1999 Falciglia ..... 463/19
6,331,143 B1 * 12/2001 Yoseloff ..... 463/18

OTHER PUBLICATIONS

"How to Play—Pick3/Pick4", Maryland Lottery web page printout dated Mar. 17, 2004, p. 1-3 http://www.mdlottey.com/h2p_pick 34.html.
"How to Play—Scratch-Offs", Maryland Lottery web page printout dated Mar. 17, 2004, http://www.mdlottery.com/h2p_scratchoffs.html.

* cited by examiner

*Primary Examiner*—Benjamin Layno
(74) *Attorney, Agent, or Firm*—Cahn & Samuels, LLP.

(57) ABSTRACT

This invention relates to a game of chance combining the attributes of lottery and casino style games. The game involves the selection of three numbers by a player from the group consisting of the digits 0 through 9 and wagering what combinations and permutations of those numbers will appear on a grid of randomly selected numbers. Winning matches pay an amount based on the probability of the combination or permutation occurring.

8 Claims, 3 Drawing Sheets

MATCH THREE NUMBERS GAME OF CHANCE

I. FIELD OF THE INVENTION

The present invention relates to novel games of chance having known probabilities of outcomes. More particularly, the present invention relates to a novel pick and match numbers game having known probabilities of outcomes and interactive computer based means and methods for playing the same.

II. BACKGROUND OF THE INVENTION

Many different games of chance and probabilities using cards or numbers are the basis for entertainment. It is not uncommon for certain types of games of chance to be adapted for lottery or casino style play. Lottery style play involves either a player scratching off tickets to reveal a sequence of numbers or icons which may result in a win or payoff if the sequence matches a pre-published sequence associated with a value; or a player picking a series of numbers which may result in a win or payoff if the selections match those later randomly drawn or selected using ping-pong balls or the like. Conventional lottery style games often fail to attract players because of the lack of control in the selection of numbers or sequences with scratch-off tickets and the like, because of the slowness of the games (as in having to wait days until the winning sequence is drawn in those games where a player selects her own numbers to play), because of the sometimes seemingly insurmountable odds against winning, or because of the lack of interactivity in the process. Some of these drawbacks are overcome by roulette, slot machines and computerized lottery games. Computerized lottery games, like Keno, allow a player to choose her lucky numbers to play and is demonstrably quick compared to conventional lottery games. However, computerized lotteries still suffer from the drawback of not being interactive enough to attract players seeking entertainment or keep players' interesting in continuing to play. Slot machines provide some interaction by allowing a user to pull a handle or push a button, but suffer the drawbacks of not allowing player's to choose their lucky numbers and not allowing players to strategize in choosing among different types of bets, etc. Roulette wheels offer players an opportunity to choose their own numbers, but still suffer from being limited in choices for play and interaction in betting strategy and the like.

Casino style play, such as Blackjack and craps, involve more interactive activities, such as deciding on different types of wagers and making choices or wagers as play develops. Casino style games lose some potential players because the games and strategy are based on events that develop during play, such as the cards a player is dealt or the result of a throw of dice. Casino style games must be capable of reasonably quick play in order to retain interest by players and to minimize time while maximizing turnover. However, casino games sometimes move too quickly for novices unfamiliar with the rules, and some people prefer to interact with a machine as opposed to a dealer and other players.

As will be appreciated, with games of chance it is critical for a profit to be built into the game so the house or organization running the game receives a profit. To ensure profit, the profit is based on probabilities, not luck. Players will accept the house making a profit, but there is a limit to the amount of acceptable profit taken in by the house. With lottery games, players typically realize the overwhelming odds against them and limit the amount spent on lottery tickets to a few dollars in hopes of the big payoff. Lottery games only succeed if there are vast numbers of players each spending a minor sum in hopes of reaping a huge, yet unrealistic, return. With casino games, players will attempt to use their "luck" to overcome the odds against them. The entertainment value and interaction of these games make players more prone to make much larger wagers, or continue playing, if the profit from probabilities in the house's favor is kept to an acceptable level.

The foregoing underscores some of the problems associated with lottery and casino type games of chance. Furthermore, the foregoing highlights the long-felt, yet unresolved need in the art for a game of chance incorporating the player attracting features of both lottery and casino type games. Furthermore, the foregoing highlights the long-felt, yet unresolved, need in the art for a game of chance which simultaneously limits the drawbacks that detract from players participating or continuing to play in a lottery or a casino type game.

III. SUMMARY OF THE INVENTION

The present invention overcomes the practical problems described above and offers new advantages as well. One object of the invention is to provide a novel game of chance. It is another object of the invention to provide a game of chance which incorporates the attributes of both lottery style and casino style games. It is a related object of the invention to provide a game of chance which minimizes the detractive features of lottery style and casino style games. It is another object of the invention to provide methods of playing the aforementioned games of chance.

It is another object of the invention to provide a game of chance that is adapted for lottery style or casino style waging. It is a further object of the invention to provide a game of chance having relatively fast turnover and which can be readily understood by most perspective players.

It is another object of the invention to provide a game of chance incorporating mathematical probabilities to ensure the house earns a profit. It is a further object of the invention to provide some degree of flexibility of payout to players to adjust the degree of profit earned by the house.

It is another object of the invention to provide a game adapted for computer-based play. It is a related object of the invention to provide a computerized game of chance incorporating the aforementioned advantageous features of the invention.

These and other objects, aspects and advantageous features of the invention may be realized by a game of chance adapted to allow a player to select three digits and then having three digits randomly selected by the house and basing the size of potential payouts to players on the probabilities of the digits appearing, but only paying out if the appearances were pre-selected by the player to occur. According to one aspect of the invention, the object of the game may be for a player to choose (or have a computer for the player) three digits and have those digits match the randomly selected three digits of the house.

According to another aspect of the invention, the highest payout may be the result of choosing three digits and having the digits of the house appear in the exact same order. According to this aspect of the invention, an advantageous feature of the invention is providing payouts for partial matches if the occurrence of the partial match was wagered to occur. According to this aspect of the invention, another advantageous feature of the invention is the provision of "Wild" or "Bonus" characters occurring instead of digits in the house's draw, whereby a player may profit from their occurrence.

According to another aspect of the invention, a player may select digits and wager on the appearance of matching digits on a grid and thus view other potentially winning combinations not chosen or attempt to discern a pattern of digit appearances on the grid for future choice of digits and wagers.

According to another aspect of the invention, a plurality of the last 3-digit combinations drawn by the house during previous plays may be posted so players may attempt to discern a pattern before choosing digits and wagering.

According to another aspect of the invention, the highest payout may be the result of choosing three digits and having the digits of the house appear in the exact same order in all playable sequences on a grid of numbers.

Given the following enabling description of the drawings, the novel game of chance and gaming methods and means for playing the same should become evident to a person of ordinary skill in the art.

IV. BRIEF DESCRIPTION OF THE DRAWINGS

The present invention is described with reference to the accompanying drawings. In the drawings, like reference numbers indicate identical or functionally similar elements.

V. DETAILED DESCRIPTION

Figure 1:
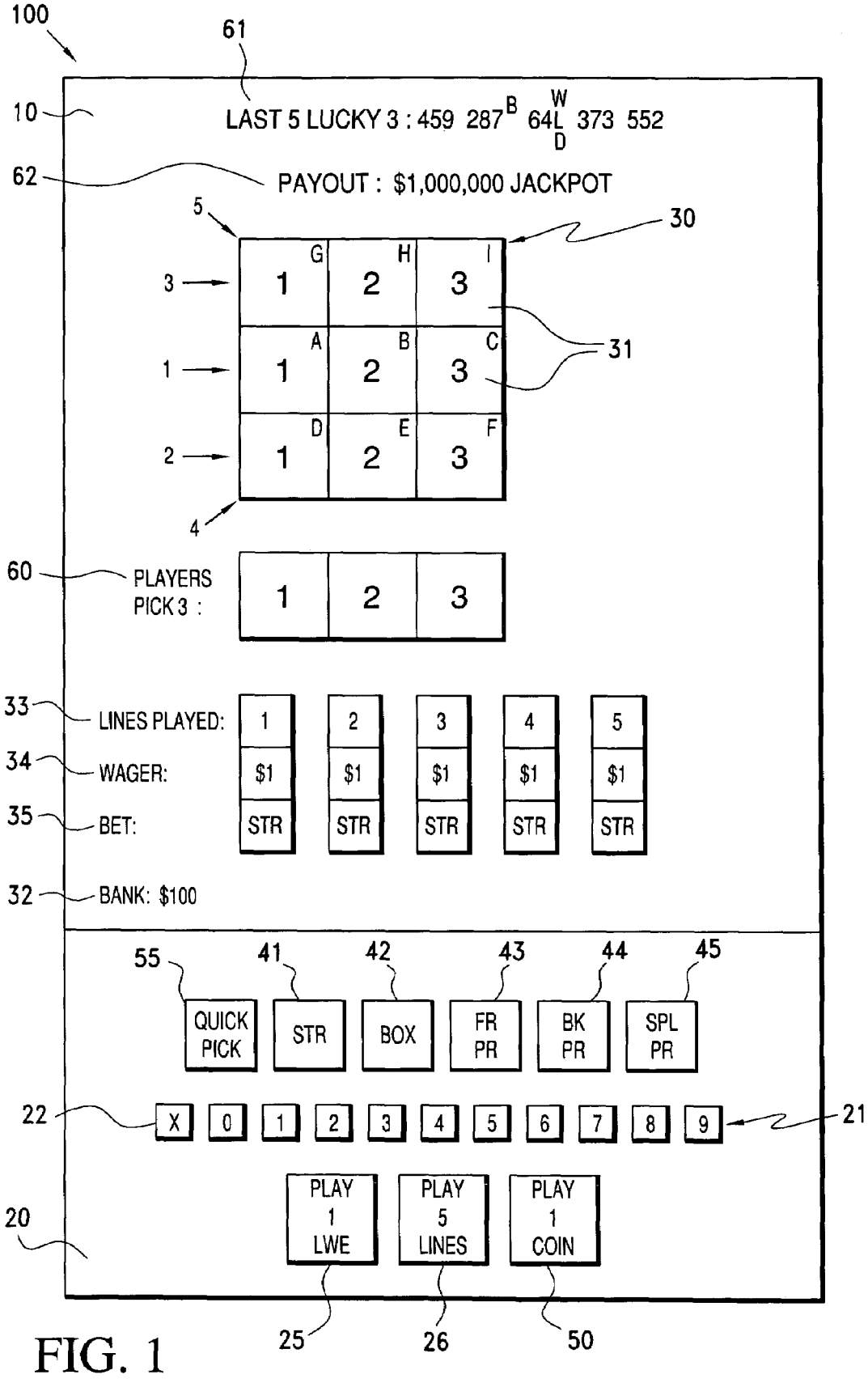
FIG. 1 is a diagrammatic representation of one embodiment of a console used in connection with a computer-based method of playing a game of chance according to the invention.

The present invention is based, in part, on the discovery that combining the attributes of lottery style games and casino style games in a gaming means and methods is attractive to players of both genre and may be configured to provide a suitable mathematically probability-based profit to the house. The present invention is also based, in part, on the discovery that such a game is readily adapted for computer-based play for use by players of both genre. "Computer-based play" should be understood to include any software and/or hardware implemented version of playing the game including but not limited to play on a stand alone gaming machine, play on a computer client, play over the Internet or WAN, play over on Intranet or LAN, or play using a PDA or the like. Also, as will be readily apparent, the invention is also easily adapted for play on a physical game board, or other non-computer based playing media.

A presently preferred embodiment of the invention is based on the probability of various permutations and combinations of 2 and/or 3 digits of a pre-selected three digit number appearing in a second randomly selected three digit number. For exemplary purposes, the present invention will described as basing payouts equivalent to ½ of the probability of the digits appearing in the various combinations and permutations at play. By only paying out at the 50% of probability of occurrence level, the house is ensured a profitable return and reserves are built up to allow for payouts which exceed the probability of occurrence such as that from "bonus," "free play," "instant winner," jackpot" and "wild-card" type play. However, one of ordinary skill in the art can choose alternate payout and profit margins to optimize the present invention for any intended purpose or audience.

According to this embodiment of the invention, at its simplest, a player selects three digits from the group consisting of 0,1,2,3,4,5,6,7,8, and 9. In this example, the player may select the same digit twice or three times, although the game could be modified to not allow a digit to be selected multiple times. Allowing a player to choose digits is attractive to lottery style gamers, although the game could be configured to allow a computer to choose for the player.

Assume for example, a player choose the digits 1,2,3. The house is then randomly assigned three digits, via computer or otherwise. Using simple statistics, the probability of the exact three-digit sequence of the digits 0–9 appearing in the house's draw is 1 in 1000 (10×10×10). Thus, if the house ends up with the digits 1,2,3 in that order, the player wins and is paid 500 times the amount of her bet. With a $1 bet, a 1 in 1000 occurrence pays $500.

To make the game more interesting and palatable to casino style gamers, different types of wagers are provided. For example, a player could "box" her digits. A "box" bet means that if the selected digits appear in any order in the house's three digits the player wins. For example, if a player chooses the digits 1,2,3 and wagers on a "box," then if the house draws 3,1,2, or any other combination of these three digits, the player wins. The probability of the same three digits appearing, albeit in a different combination, is 1 in 160. Accordingly, a player with a $1 box bet would win $80. In addition to "box" bets, the present invention contemplates "front pair," "back pair," and "split pair" bets. A "front pair" is a bet that the first two of the player's selected digits will appear in order. In the present example, a house draw of 1,2,X would win, wherein X is any digit 0–9. A "back pair" is a bet that the last two of the player's selected digits will appear in order. In the present example, a house draw of X, 2,3 would win. Likewise, a "split pair" is a bet that the first and third of the player's digits will appear as the first and third digits in the house's draw. Accordingly, a house draw of 1,X,3 would win. The probability of correctly predicting the occurrence of two digits is 1 in 100 (10×10); and thus these wagers would pay $25 on a $1 wager. These odds decrease in a player's favor with the inclusion of "wild card" type play or the inclusion of other variables that increase the odds of a winning draw or higher payout.

To make the game and method of the present invention even more attractive and interactive to gamers, a game grid is contemplated. The game grid will include cells for housing digits in multiples of three, for example, 6 cells, 9 cells, 12 cells, etc. By providing a game grid, a player may choose three numbers and then wager that various combinations of cells on the grid will match some or all of the player's numbers. Presently preferred is a 9-cell grid because it is optimal for allowing a player to choose 3-cell combinations in the horizontal, vertical and diagonal directions. In accordance with this feature of the invention, the game grid's cells house digits randomly selected from 0 though 9 (and possibly other characters for play as described more fully herein).

The features of the invention described above are particularly adapted for computer-based applications of the invention. FIG. 1 depicts a console 100 of a computer-based, or slot machine-type, game machine for playing an embodiment of the game of chance of the present invention. As depicted, console 100 includes a visual display area 10 and a user interface area 20. In this embodiment, visual display area 10 is a video screen for displaying data and characters by illuminating specific pixels in response to instructions generated by the processor of the computer of the gaming machine configured for playing the game of chance of the present invention.

Visual display area or screen 10 depicts a grid 30 having nine boxes or cells 31. Boxes 31 are lettered A though I for ease of identification in the examples that follow. Boxes 31 each depict a single digit. The digits and their significance will be elaborated on in the paragraphs that follow. Suffice it for now to state that the digits represent the house's draw of random characters to exemplify the game according to this embodiment.

The visual display area 10 of console 100 includes digits 1–5. Digits 1–5 each identify or are associated with a specific line on grid 20. Line 1 represents boxes A,B,C in that specific right to left, horizontal order. Line 2 represents boxes D,E,F in the specific right to left, horizontal order. Line 3 represents boxes G,H,I in that specific right to left, horizontal order. Line 4 represents boxes D,B,I in that specific right to left, ascending diagonal order. Line 5 represents boxes G,B,F in that specific right to left, descending diagonal order.

The grid 30 and associated lines 1–5 allow players to play multiple wagers and different types of bets. According to a preferred embodiment, a player desiring to play, deposits money, tokens, or otherwise obtains credits to wager. The amount a player has to wage could be depicted on the screen 10 as a value associated with a "BANK" icon 32 or the like visual depiction of a players' credits and/or winnings.

In alternative embodiments of the invention, such as Internet based play or PDA play, a player may enter a credit card number or the like instead of depositing money, coins, and tokens into a game machine. These type of remote play options and embodiments are less preferred than use of a stand-alone game machine disposed in a casino or other area suited for gaming.

According to the invention, a player first selects the number of lines she will play. Alternatively, this step could follow or be performed concurrently with the wagering step and/or betting step. In this embodiment, if the user presses the "Play 1 Line" button 25 on the user interface 30 of console 10, the user will be playing line 1 (cells A,B,C). If the user presses the "Play 1 Line" button 25 again, the user will be playing both lines 1 and 2 (cells DEF). Sequential depressions will result in the next sequential line being selected for play. Although the grid depicted in FIG. 1 contemplates play of up to 5 lines corresponding to the cells on the axis of the associated arrows, the present invention should not be viewed as so limited. As will be appreciated, in wagering on 3 contiguous cells in the left to right direction, 17 lines are possible. In addition to the 5 lines already identified, contiguous 3-cell series include GEF, GEI, GHF, ABF, AEC, AEF, DBC, DBF, DEC, DEI, DHF, and DHI. In addition, the cells could be played in the right to left, up to down, and down to up direction if desired. Indeed, the console could be modified to include an alphanumeric pad for allowing players to choose combinations of contiguous and/or non-contiguous cells. Accordingly, the present invention should not be limited to a game having only 5 possible lines to play.

The "Play 1 Line" button 25 could also be configured to allow multiple depressions to allow a user to select to play on line 5, or some other line, to play, if a player desires to play 1 line but prefers cells different then ABC. Alternatively, the player could be prompted by text in visual display area 10 to press the line numbers from the numeric keys 21 for the lines, or number of lines, the player chooses to play.

In the present example, the user could also select the "Play 5 Lines" button 26, and play all five of the 3-cell lines previously described above. This "Play 5 Lines" button 26 would encourage multiple wagering by gamers and enhance the speed of the game and the profit to the house by facilitating multiple plays. In addition, the "Play 5 Lines" button 26 could be a "Jackpot" play wherein if a user wins in all five directions, as is depicted in FIG. 1, the user wins a jackpot of a substantial, or lottery-type, amount of money.

After or in conjunction with choosing lines and the amount of wagers, a gamer must choose what types of bets to be placed. In the embodiment of FIG. 1, the gamer is provided buttons for the available bet-types. If a straight bet is desired, the user simply presses the "STR" button 41 for the line that wager is to be associated with. Likewise, the user can press the "BOX ANY" key 42 to box a line, the "FR PR" key 43 to wager on the front pair of the player's numbers occurring on a line, the "BK PR" key 44 for the back pair, or the "SPL PR" 45 for the first and third digits appearing.

The user must indicate the amount of the wager for each line and bet. The wagering step could occur before, after, or simultaneously with the selecting of lines and betting steps. In the embodiment in FIG. 1, the "Play 1 Coin" button 50 is pressed to indicate a single coin or token is wagered. The button 50 may be pressed multiple times to increase the wager to multiple coins. Alternatively, a wager amount could be entered using the numeric keys 21 on the user interface 20 portion of the console 100 in response to a prompt. Preferably, the player is prompted by text in visual area 10 to make a wager for a given line being played. In the embodiment of FIG. 1, the player is provided with a "LINES PLAYED" icon 33 with 5 areas or fields associated with each of the five respective lines that can be played. Likewise, the user is provided with a "WAGER" icon 34 having 5 areas or fields for prompting a player to indicate the amount of a wager for a given line being played. Moreover, the player may be provided with a "BET" icon 35 having areas or fields associated with each line for indicating the type of bet made by the player for each respective line. In any event, any suitable means for prompting and/or placing a wager and bet-type for any given line is contemplated by the invention.

After wagering, the gamer selects her three digits to be played. The digits are entered in order using the numeric keys 20. Alternatively, a player may simply depress the "QUICK PICK" key 55 to allow the computer to select three random digits. Depicted on console 100 in visual display area 10 is player's selection 60. Player's selection 60 depicts the three digits (namely 1,2,3 in this example) chosen by a player, or alternatively, by the game machine's computer processor if desired. As discussed previously herein, payouts based on these digits and depend on the wagers, bets and lines played by the player using grid 30 and the house's draw.

According to the invention, the system can be configured to default and prompt players as desired. For example, the game can default to a single coin bet on line 1 such that a user simply hits the "QUICK PICK" button 55, or the "QUICK PICK" button 55 then a "PLAY" button 22.

The game can also incorporate automatic payouts or include buttons or ways of selecting other types of bets, such as betting that 2 of the player's 3 digits will appear in a line in any order, betting that a number will appear twice in a line, or betting that the same number will appear in all three cells of a line. One of ordinary skill in the art armed with the present specification will appreciate that any event having a known probability may be included as a bet-type if desired. The payouts are preferably based on the probabilities of these events occurring.

The game is also preferably configured to include "Wild" and "Bonus" type play, wherein certain cells in the grid randomly include, for example, the Icon "Wild." A "Wild" allows a player to treat the cell as automatically matching her digit. "Bonus" play could be off-grid and simply a random event providing a player with a chance to double or triple winnings if the player wins a wager in the play in which the bonus appears (such as after the player selects her numbers, but before the house gets its draw). The "Bonus" could also include free plays or increased winnings or the like, but only if a digit in the cell with the "bonus" is matched by a player's selection. For example, cell A may include both the digit 1 and the word "bonus" wherein a free play is won if the player had chosen the digit 1 to appear in cell A. It is well with the ability of one of ordinary skill in the art to appreciate and incorporate other random features that may enhance a player's interest or enjoyment of the game.

After player's numbers are chosen and depicted, the house gets its draw for the cells 21 of the grid 20. One advantageous feature of using a grid 20 is that it allows players to view unplayed lines. This may add excitement to the game by allowing players to see how close they were to winning or facilitating attempts to discern patterns to the numbers to devise a wagering scheme. Another advantageous feature of the invention is providing for the screen 10 to depict the immediately preceding grid(s), or in the embodiment of FIG. 1, the last 5 house draws in a "LAST 5 LUCKY 3," to add yet another variable for players to consider in attempting to discern patterns in the numbers or in choosing their numbers and lines to play.

According to another aspect of the invention, the grid may be configured to be filled in with numbers and then removing all numbers which do not correspond to any of the numbers selected by the player to aid in determining potentially winning sequences. Alternatively, chosen numbers may simply be highlighted or otherwise able to be discriminated from non-picked numbers. The grid may also be configured to highlight or otherwise indicate winning sequences. In a preferred embodiment, numbers superimpose if matched. In this regard, the system may be equipped to provide audio and visual effects when garners have winning selections to add to the excitement of the game. For example, the embodiment in FIG. 1 includes a "PAYOUT" field 62 depicting a players winnings. As shown, the payer won the $1,000,000 Jackpot for wagering on and matching the sequence in all 5 lines.

If the gaming grid of the present invention is incorporated into a mechanical reel, slot-machine type of device, the digits selected for each row of cells is preferably selected from a reel having at least 301 characters comprising 3 sets of each digit, or three hundred digits, one bonus associated with one of the digits, and one wild. Preferably, the reel includes more than 301 characters.

In an alternative embodiment of the present invention, only line 1 is depicted on visual screen. In order for more lines to appear and be played, additional wagers must be placed. For example, if one coin is deposited a first line appears, if a second coin is deposited, a second line appears, and so on. In this embodiment, the matching of sequences is quickly determined given that there are no playable diagonal or non-linear combinations. This embodiment provides ease to the gamer and speeds up play. This embodiment is also preferably adapted to allow for the types of wagering and bets discussed above.

Figure 2:
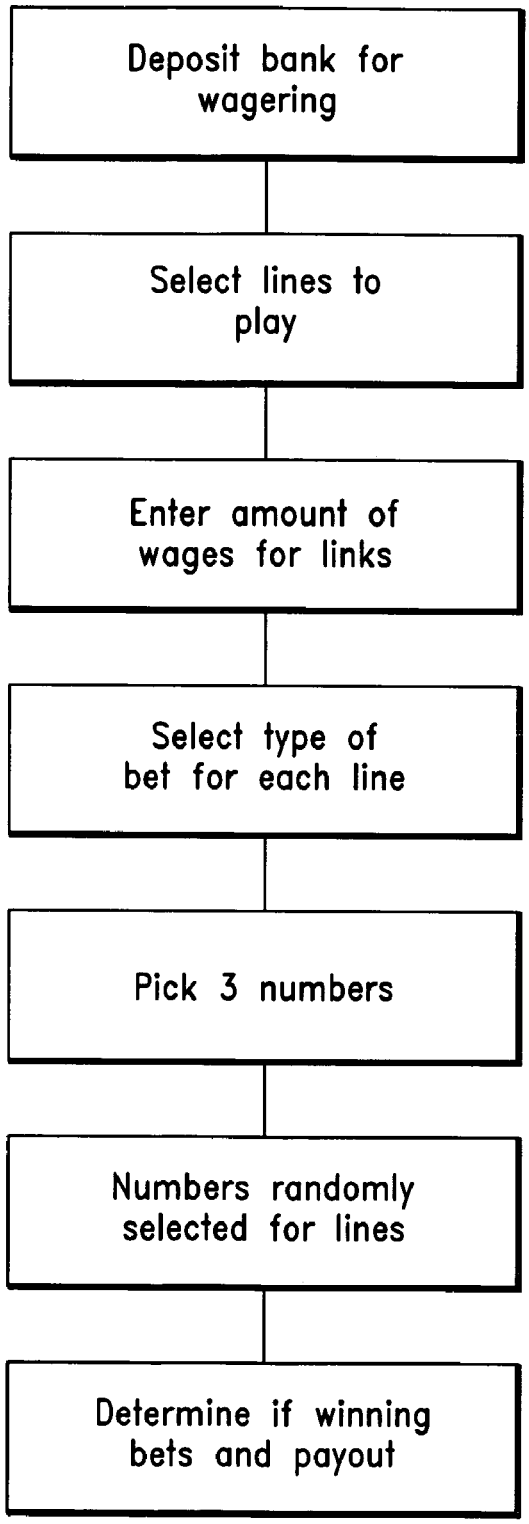
FIG. 2 is a flow chart illustrating steps of one embodiment of a method of playing a game of chance according to the invention.

FIG. 2 is a flow chart illustrating the steps of a presently preferred method of playing a preferred embodiment of the invention. However, the steps do not need to be performed in the exact order shown. Some steps are suitable for occurring in a different sequence or simultaneously with other steps. Likewise, the steps shown are not all inclusive. The methods could be modified to include other aspects to the play of the game.

Figure 3:
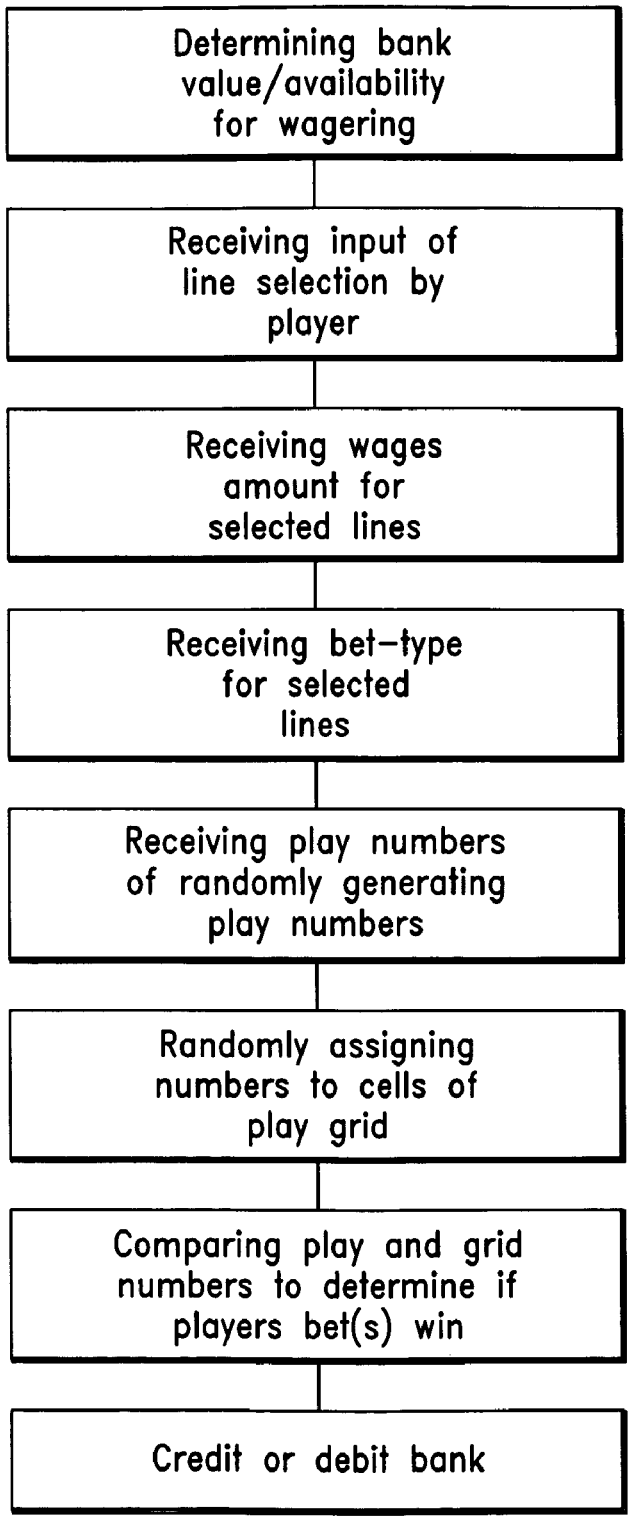
FIG. 3 is a flow chart depicting the steps of a computer-implemented version of playing a game of chance according to the invention.

FIG. 3 depicts a flow chart of a computer-based implementation of a presently preferred embodiment of the invention. Again, the depiction does not necessarily include the universe of steps that may be included or the mandatory order for the steps to occur.

As will be appreciated by one of skill in the art, the present invention may be embodied as a computer implemented method, a programmed computer, a data processing system, a signal, and/or computer program. Accordingly, the present invention may take the form of an entirely hardware embodiment, an entirely software embodiment or an embodiment combining software and hardware aspects. Furthermore, the present invention may take the form of a computer program on a computer-usable storage medium having computer-usable program code embodied in the medium. Any suitable computer readable medium may be utilized including hard disks, CD-ROMs, optical storage devices, or other storage devices.

Computer program code for carrying out operations of the present invention is preferably written in a plurality of languages including ASP (Active Server Pages), HTML (Hypertext Markup Language), SQL (Structured Query Language), and C++. However, consistent with the invention, the computer program code for carrying out operations of the present invention may also be written in other conventional procedural programming languages.

The program code preferably executes entirely on a game machine as a stand-alone software package so that the invention may take the form of a hand-held game machine for amusement (such as a GAMEBOY® by Sony®) or slot-type game or arcade-type machines for placement in a casino or other gaming area. Alternatively, the program code may execute partly on a machine such as a user's client computer and partly on a remote computer or processor. In the latter scenario, the remote computer may be connected directly to the user's client device via a LAN or a WAN (Intranet), or the connection may be made indirectly through an external computer (for example, through the Internet, a secure network, a sneaker net, or some combination). A system could be configured where multiple players compete at the same time using the same house draw for the grid.

The present invention has been described with reference to flowchart illustrations of methods, apparatus (systems) and computer programs in accordance with the several embodiments of the invention. It will be understood that each block of the flowchart illustrations and block diagrams, and combinations of blocks in the flowchart illustrations and block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means or program code that implements the function specified in the flowchart block or blocks.

The computer program instructions may also be loaded, e.g., transmitted via a carrier wave, to a computer or other programmable data processing apparatus to cause a series of operational steps to be performed on the computer or other programmable apparatus to produce a computer implemented process such that the instructions which execute on the computer or other programmable apparatus provide steps for implementing the functions specified in the flowchart block or blocks.

According to the present invention, the software may be stored locally on a provider's stand-alone computer terminal or game machine, or on a user's client device such as a desktop computer, laptop computer, palmtop computer, or personal digital assistant (PDA) or the like. Exemplary game machine's include arcade-type machines, slot-type machines and hand held devices such as GAMEBOY® by Sony®. Exemplary stand-alone computers may include, but are not limited to, Apple®, Sun Microsystems®, IBM®, or IBM®-compatible personal computers. Accordingly, the present invention may be carried out via a single computer system, such as a desktop computer or laptop computer.

According to an embodiment, the software for playing the game may be centrally stored within one or more computers accessible to multiple users. Accordingly, users may access the software through a private or public computer network in a conventional manner via wired or wireless communications. By maintaining the database in a central location, updates can be easily made to the database by a system administrator without having to access all of the machines in the network. Likewise, a centrally maintained system is optimal for receiving and making payments if the game involves montetary wagering.

As is known to those with skill in this art, network environments may include public networks, such as the Internet, and private networks often referred to as "Intranets" and "Extranets." The term "Internet" shall incorporate the terms "Intranet" and "Extranet" and any references to accessing the Internet shall be understood to mean accessing an Intranet and/or an Extranet, as well unless otherwise noted. The term "computer network" shall incorporate publicly accessible computer networks and private computer networks.

There are a variety of emerging commercial off the shelf wireless technologies that could be used to implement the invention. WaveLan is a wireless LAN technology that utilizes the Orinoco IEEE (PCMCIA Type II) PC Card with integrated antennas (antenna diversity)+connector for external antenna for mobile equipment (notebooks, handheld, MSD 1), with 915 MHz and 2.4 GHz versions as well as optional WEP encryption. This technology is widely used for static wireless LAN implementations at speeds up to 10 Mb/second.

Bluetooth is an alliance between mobile communications and mobile computing companies to develop a short-range communications standard allowing wireless data communications at ranges of about 10 meters. Bluetooth encompasses both a standard communications interface and a low-cost computer chip. It is a cross between the DECT (Digital European Cordless Telephone) and iRDA (infra Red Data Association) technologies. Bluetooth does not involve mobile network transactions as its spectrum is freely available to use in the unlicensed spectrum area (2.45 GHz). Data transmission speeds using Bluetooth are expected to be between 720 kbps and one megabit per second (Mbps). Bluetooth will facilitate WLAN in which networks of different handheld computing terminals and mobile terminals can communicate and exchange data, even on the move and when there is no line-of-sight between those terminals. Bluetooth technologies are designed to be functional even in very noisy radio environments, and Bluetooth voice transmissions are audible under severe conditions. Applications can include pagers, wireless phones, VTC, normal data, e-mail, and web streaming. One possible use of Bluetooth to implement the invention is for inexpensive high bandwidth communications between a client and a host machine operated by the house.

Code Division Multiple Access (CDMA) High Data Rate (HDR) provides a spectrally efficient 2.4 Mbps peak rate in a standard 1.25 MHz channel bandwidth for fixed, portable and mobile applications. Optimized for packet data services, HDR incorporates a flexible architecture based on standard IP. HDR is an evolution of CDMA technology with identical radio frequency characteristics as cdma2000 Ix. HDR supports e-mail, web browsing, mobile e-commerce, telegaming and many other applications while offering end users continuous, untethered, always on access to the Internet and next-generation data services. QUALCOM and LUCENT have announced plans to market High Data Rate (HDR) Code Division Multiple Access (CDMA) based cell phone IP networking in the near term. One possible use of this technology in implementation of the invention is to provide remote and long distance LAN-like access to IP networks that Bluetooth will provide locally. An exemplary embodiment of the invention employs both a provider or house server and client wireless Personal Data Assistant (PDA) and laptop configurations (where appropriate) (or other types of remote computing devices).

Regardless of the medium for play, an advantageous feature of the invention is the provision of numerous chances for payouts, albeit typically moderate, which is encouraging to players. Another advantageous feature of the invention is the interaction in wagering and the ability to choose one's own numbers to play. These and other advantageous features may be optimized or modified to enhance the present gaming method and means to maximize profit, play or interest for a desired audience of clientele.

Those skilled in the art will appreciate that various adaptations and modifications of the above-described preferred embodiments can be configured without departing from the scope and spirit of the invention. Therefore, it is to be understood that, within the scope of the appended claims, the invention may be practiced other than as specifically described herein.

I claim:

1. A method of playing a game of chance comprising the steps of:

selecting a wager;

selecting a bet-type having criteria for winning said wager, wherein said bet-type is selected from the group consisting of straight, box, front pair, back pair, and split pair;

selecting three player numbers, wherein said player numbers and said house numbers are selected from the group consisting of the digits 0, 1, 2, 3, 4, 5, 6, 7, 8, and 9;

comparing said three player numbers to three randomly selected house numbers, randomly assigned to cells of a three cell by three cell grid;

determining if said compared sets of numbers satisfy said criteria for said bet-type;

wherein if said criteria is satisfied for a bet-type a player wins a sum based on the probability of said criteria being satisfied.

2. The method of claim 1 further comprising:

selecting at least one line corresponding to three contiguous cells of said grid for comparing with said player numbers.

3. The method of claim 2 further comprising selecting up to five lines for comparison to said player numbers, each of said lines corresponding to a specific three cell combination.

4. The method of claim 3 wherein said lines correspond to contiguous cells in an order from right to left.

5. The method of claim 2 further comprising:

selecting to play 1 to 5 lines, each of said lines corresponding to three contiguous cells of said grid;

selecting a wager for each line selected; and selecting a bet-type for each line wagered.

6. The method of claim 5 wherein said lines comprise contiguous cells in an order from left to right.

7. The method of claim 6, wherein 5 lines are selected for play.

8. The method of claim 5 wherein said universe of house numbers includes a chance of a wild-card being deposited in a cell.

* * * * *